US006082230A

United States Patent [19]

Steinweg

[11] Patent Number: 6,082,230

[45] Date of Patent: Jul. 4, 2000

[54] FUEL FILTER CAP TOOL

[75] Inventor: Paul Steven Steinweg, Lititz, Pa.

[73] Assignee: Hand Tool Design Corporation, Wilmington, Del.

[21] Appl. No.: 09/265,088

[22] Filed: Mar. 9, 1999

[51] Int. Cl.[7] ..... B25B 13/48

[52] U.S. Cl. ..... 81/176.15; 81/124.2

[58] Field of Search ..... 81/119, 124.2, 81/176.1, 176.15, 461, 180.1, 185.1, 3.07, 3.4, 58.1; 7/100

[56] References Cited

U.S. PATENT DOCUMENTS

| | | | |
|---|---|---|---|
| 107,255 | 9/1870 | Harris | 81/124.2 |
| 423,288 | 3/1890 | Tefft et al. | 81/176.15 |
| 3,371,563 | 3/1968 | Lallo | 81/124.2 |
| 3,768,345 | 10/1973 | Barnes | 81/176.15 |
| 4,542,666 | 9/1985 | White | 81/119 |
| 4,831,904 | 5/1989 | Agins | 81/176.15 |
| 5,003,848 | 4/1991 | Ceccucci, Jr. | 81/3.4 |
| 5,154,102 | 10/1992 | Becker | 81/176.15 |
| 5,524,511 | 6/1996 | Taka's | 81/176.15 |
| 5,618,143 | 4/1997 | Cronin, II et al. | 81/461 |
| 5,845,552 | 12/1998 | Piascik | 81/176.15 |
| 5,862,721 | 1/1999 | Kowats | 81/3.4 |

*Primary Examiner*—David A. Scherbel
*Assistant Examiner*—Joni B. Danganan
*Attorney, Agent, or Firm*—Leonard Bloom

[57] ABSTRACT

A tool having a base and legs, the ends of the legs each having a notch formed therein. The notch engages cooperating ribs formed in a fuel filter end cap such that a drive attached to the tool may rotate the cap for installation and removal.

4 Claims, 6 Drawing Sheets

FUEL FILTER CAP TOOL

FIELD OF THE INVENTION

The present invention relates to a tool for removal and installation of a fuel filter cap and more particularly to a tool for use with a fuel filter cap which has radial ribs.

BACKGROUND OF THE INVENTION

Some vehicles have a fuel filter which must be serviced after the engine has run for a predetermined number of miles. The fuel filter cap on the filter is difficult to remove and the applicant is unaware of any existing tool which can be used with the fuel filter cap.

In particular, the Ford Motor Co. has a 7.3 L diesel engine with a top mounted fuel filter that is to be serviced at 20,000–30,000 mile periods. The cap holds a filter in a pressurized system and the cap is threadingly mounted on the engine.

There is a need for a simple tool to remove and install the fuel filter cap.

BRIEF SUMMARY OF THE INVENTION

It is an object of the present invention to provide a simple tool to remove and install fuel filter caps.

In accordance with the teachings of the present invention, there is disclosed a tool for use with a fuel filter cap. The fuel filter cap has a plurality of spaced-apart ribs formed radially thereon. The tool has a body having a base having opposite ends. A pair of legs are provided, each leg formed angularly at an opposite end of the base. Each leg has an end distal from the base, a notch being formed in the respective end of each leg. A means for engaging a drive is formed at approximately a midpoint of the base. The tool is disposed over the fuel filter cap with the respective notches in the legs engaging the cooperating ribs on the fuel filter cap. The drive engages the means on the tool to rotate the tool with the cap in a forward or a reverse direction.

These and other objects of the present invention will become apparent from a reading of the following specification taken in conjunction with the enclosed drawings.

DESCRIPTION

Figure 1:
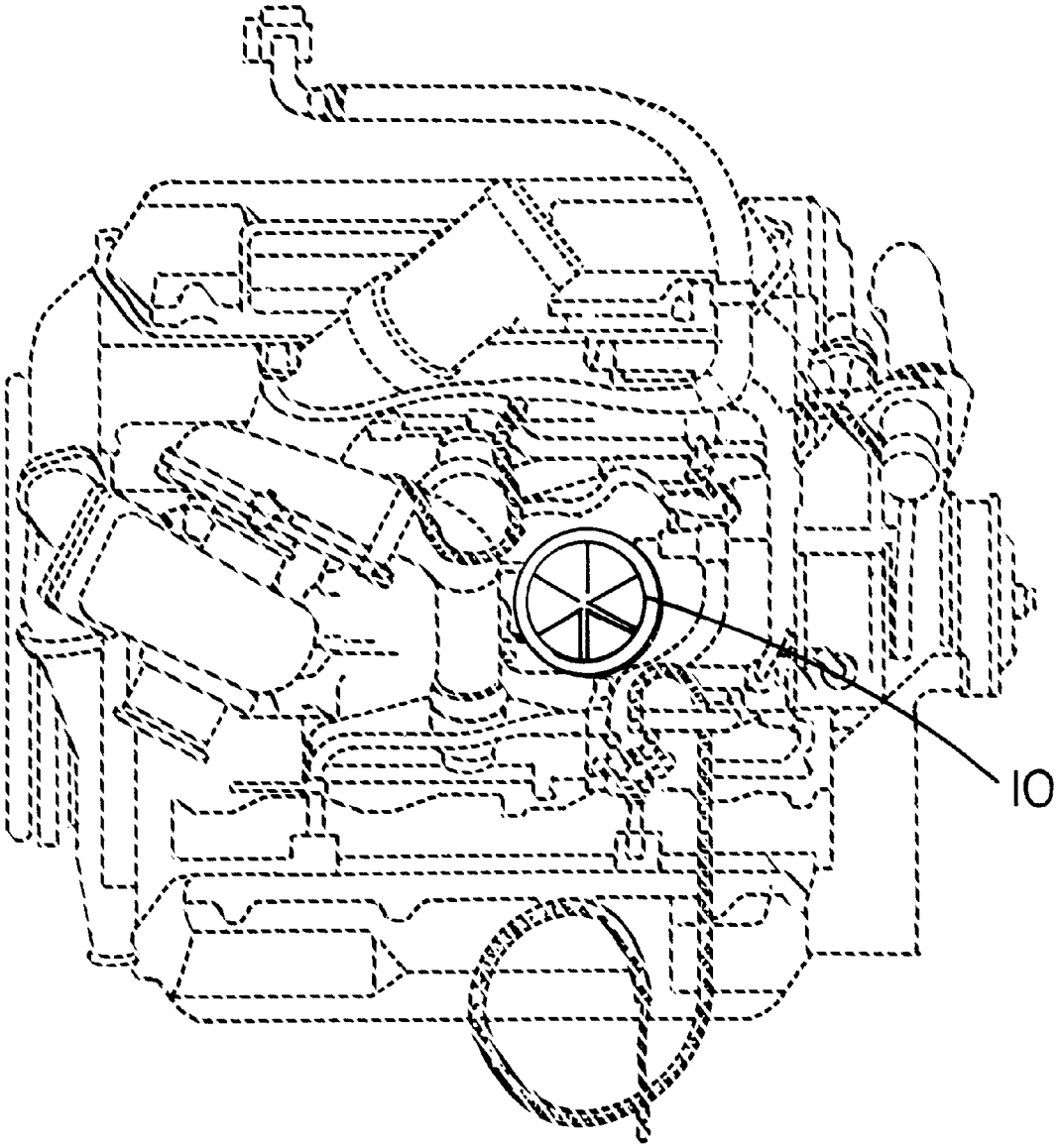
FIG. 1 is a top plan view of an engine having a fuel filter cap.
Figure 2:
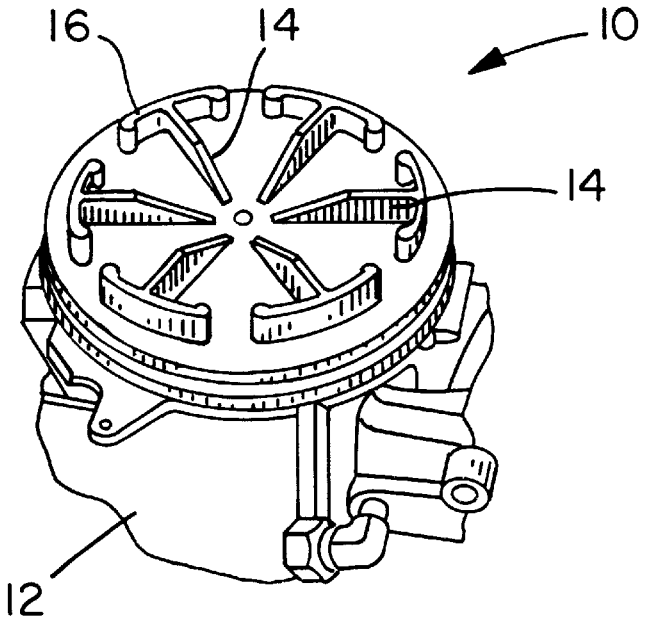
FIG. 2 is a perspective view of one embodiment of the fuel filter cap on a filter housing.
Figure 3:
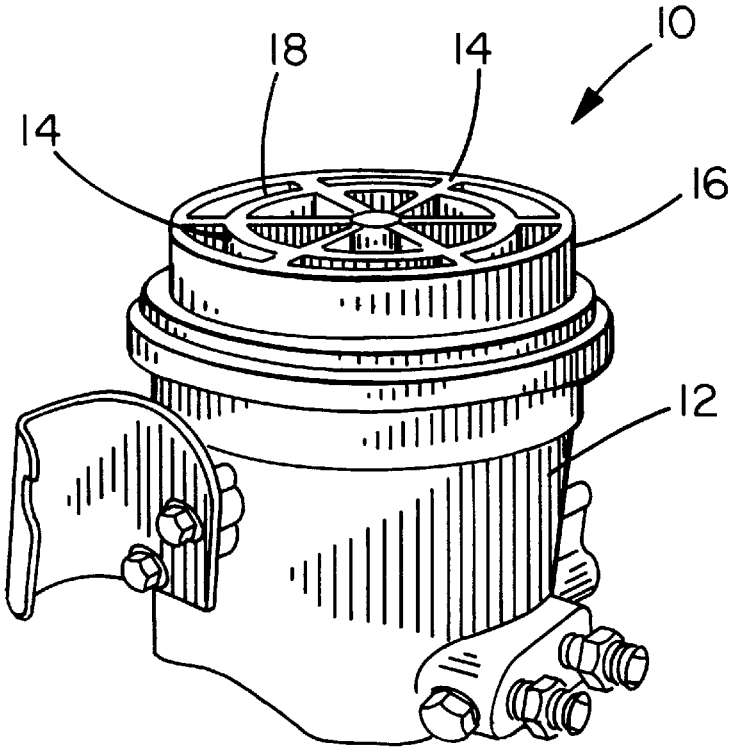
FIG. 3 is a perspective view of a second embodiment of the fuel filter cap on a filter housing.
Figure 4:
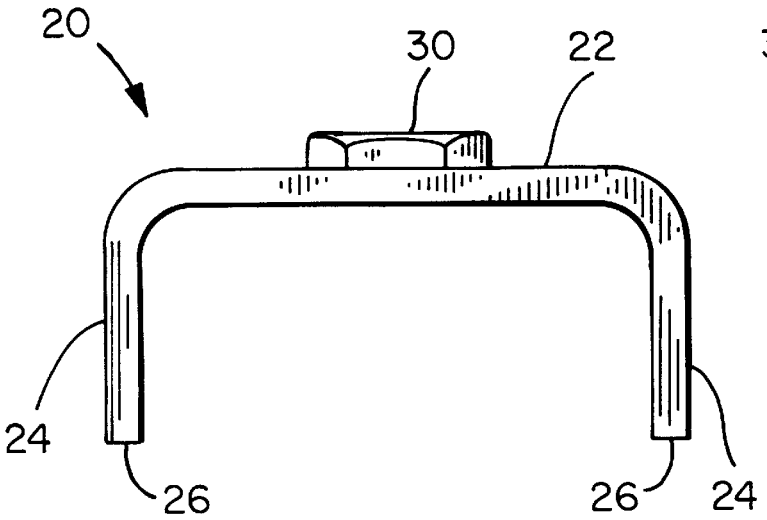
FIG. 4 is a side elevation view of the tool of the present invention.
Figure 7:
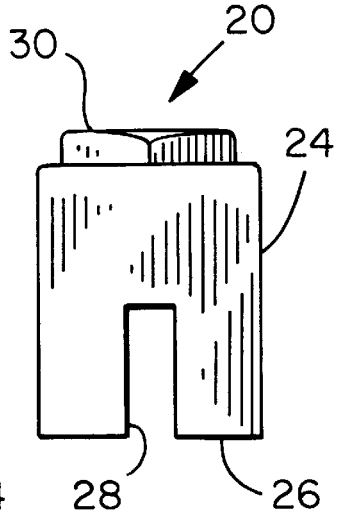
FIG. 7 is an end view of the tool of FIG. 4.
Figure 5:
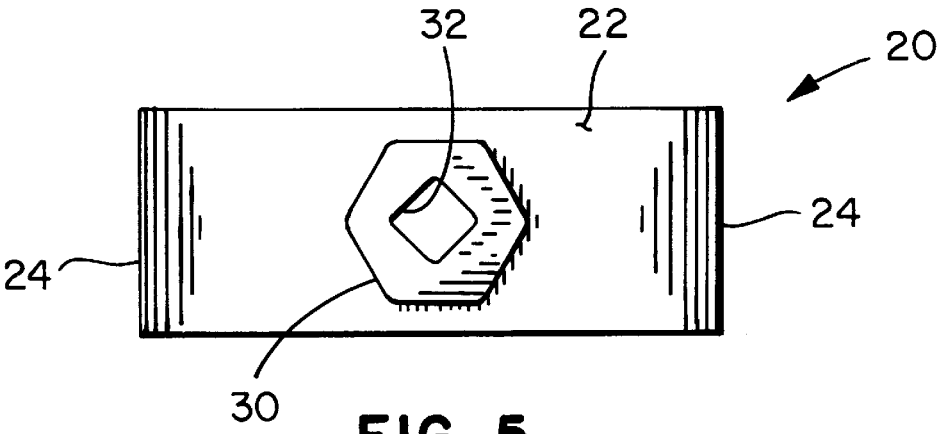
FIG. 5 is a top plan view of the tool of FIG. 4.
Figure 6:
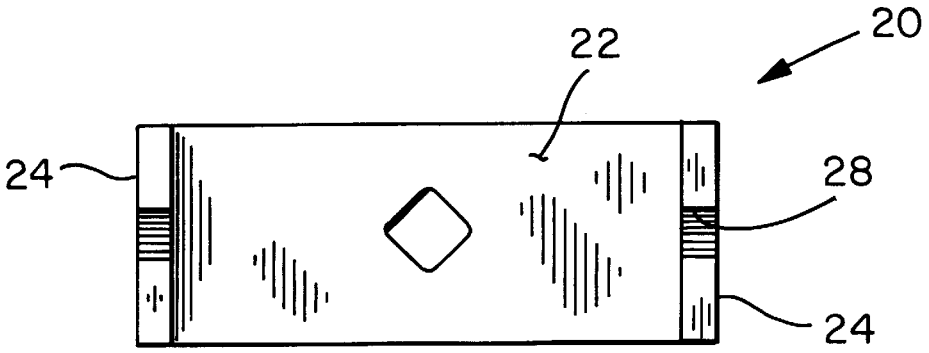
FIG. 6 is a bottom plan view of the tool of FIG. 4.

Referring to FIG. 1, the fuel filter cap 10 is mounted on the top of fuel filter canister 12 on a Ford 7.3 L diesel engine. The fuel filter cap 10 is circular and has a threaded edge to cooperate with threads formed on the fuel filter canister 12. The top surface of the cap 10 has a plurality of spaced-apart ribs 14 formed radially thereon from a center of the cap. Preferably, each rib 14 is at an angle of 60° from the adjacent rib. Each rib 14 is joined to a circumferential wall 16 formed near the outer edge of the top of the cap 10. The wall 16 may be interrupted (FIG. 2) or continuous (FIG. 3). Also, an inner wall 18 may be formed concentric with the outer wall 16 (FIG. 3) to provide additional strength to the ribs 14.

The tool 20 has a body consisting of a base 22 with opposite ends and a pair of legs 24. Each leg 24 is formed angularly with respect to the base 22 at the opposite ends of the base 22. Each leg 24 has an end 26 distal from the base 22. A notch 28 is formed in the end 26 of each leg 24, the notch 28 being at the approximate midpoint of the end 26 and extending toward the base 22.

At approximately the midpoint of the base 22 between the legs 24, a means 30 is formed on the base 22 to engage a drive. As shown in FIGS. 4–7, the means may be a boss 30 formed on the upper surface of the tool 20 opposite from the legs 24. Preferably an opening such as a square is formed in the boss 30 to receive therein the drive tang of a ratchet wrench 34. Alternately, the boss 30 may have a hexagonal outer perimeter such that an open end wrench, a box wrench or a socket may be disposed thereon to drive the tool 20 and the cap 10 as will be explained.

Figure 8:
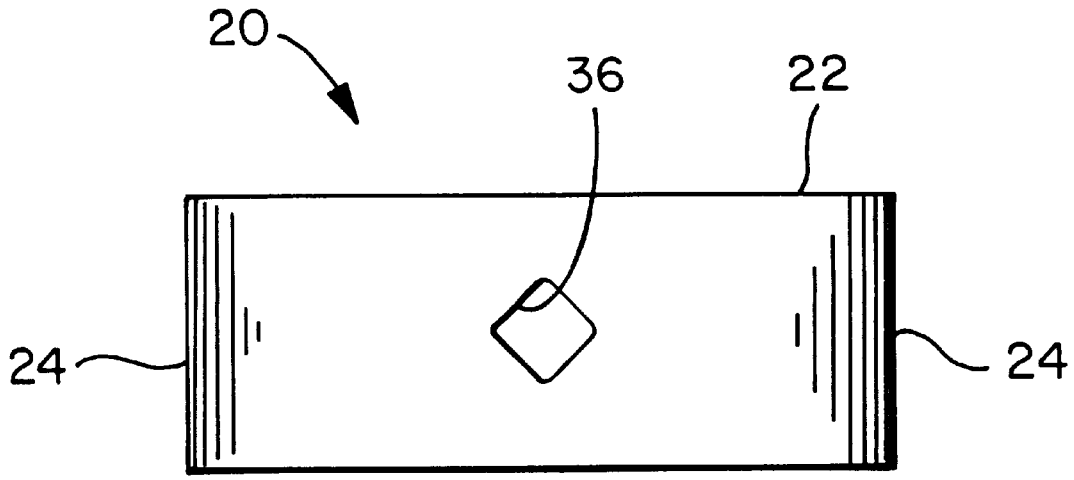
FIG. 8 is a top plan view of another embodiment.
Figure 9:
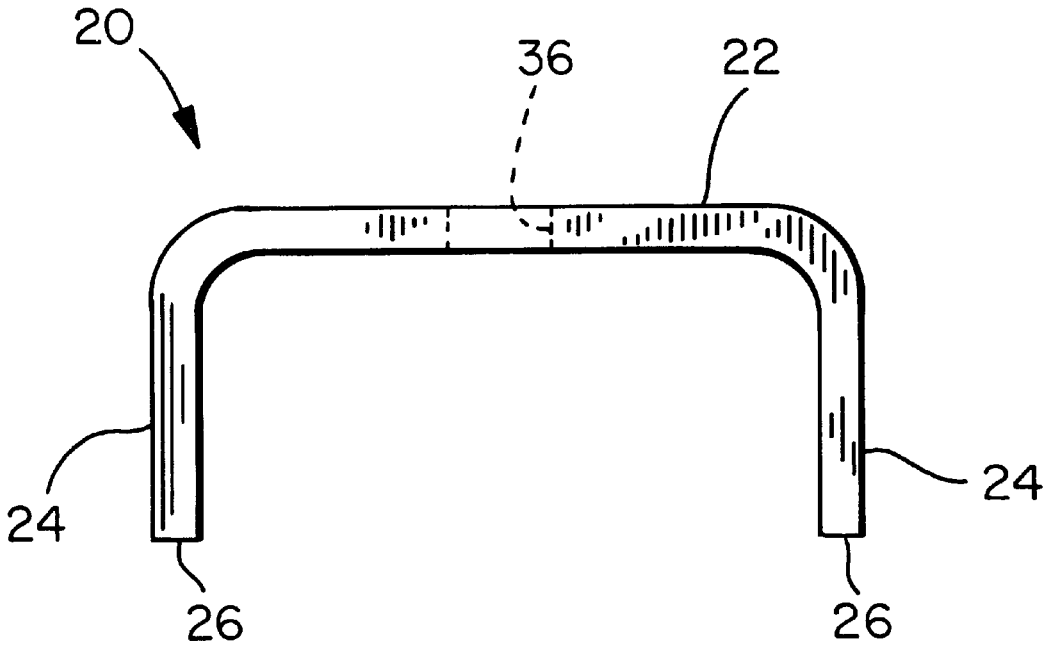
FIG. 9 is a side elevation view of the embodiment of FIG. 8.

In an alternate embodiment (FIGS. 8 and 9) the tool has an opening 36 formed in the base 22 in which a drive is received. Preferably, the opening is square to receive the tang on a ratchet wrench.

Figure 10:
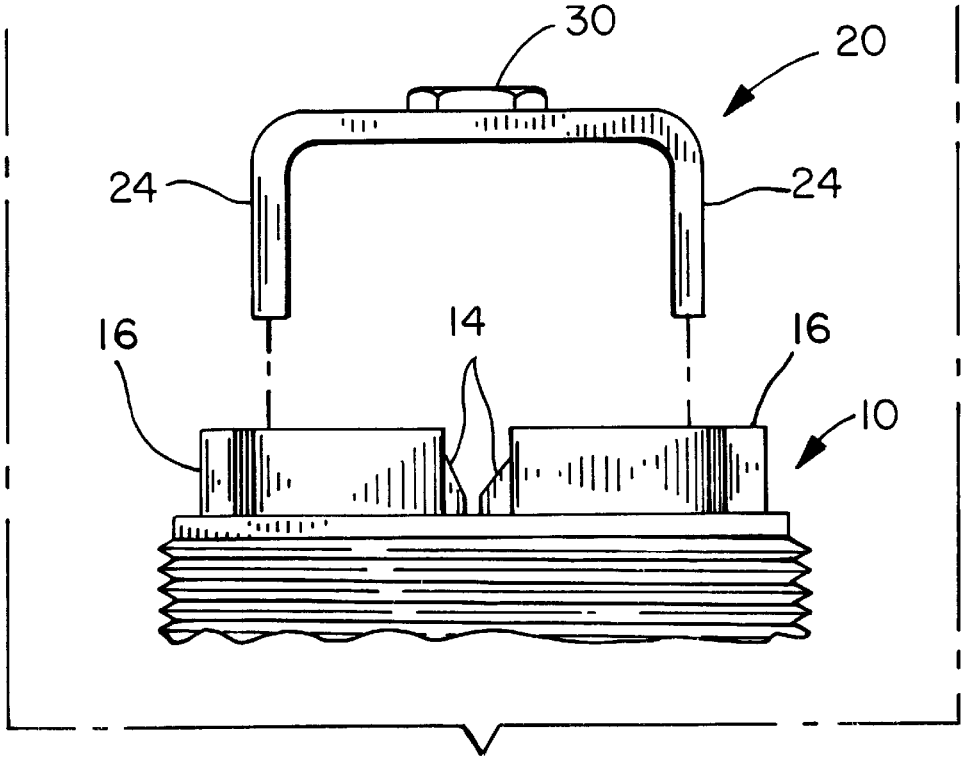
FIG. 10 is a side elevation view of the tool being placed on the fuel filter cap.
Figure 11:
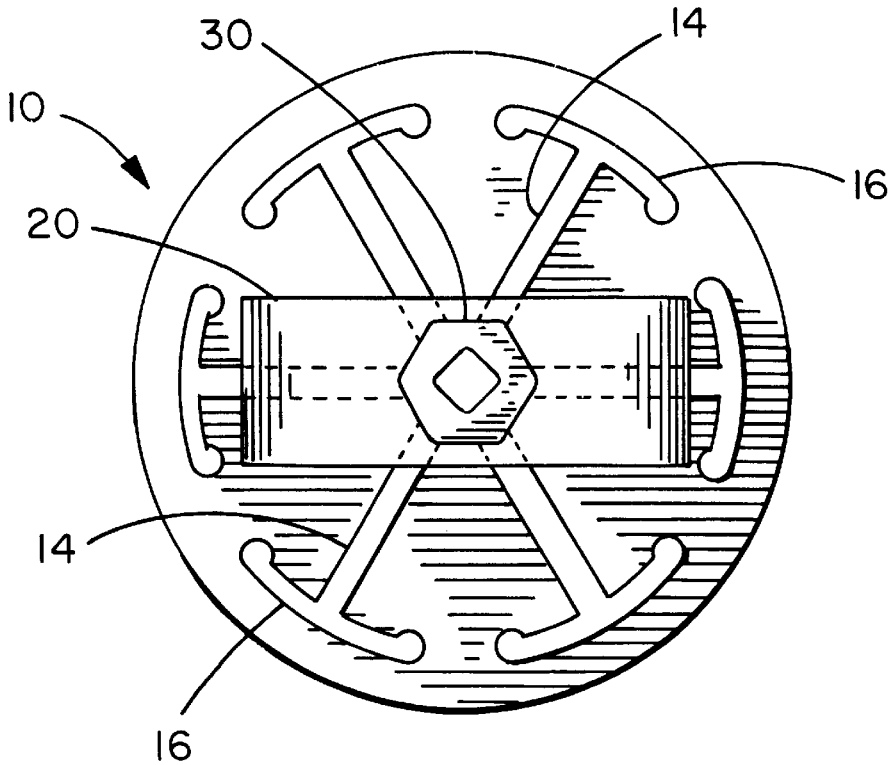
FIG. 11 is a top plan view of the tool disposed on the fuel filter cap.
Figure 12:
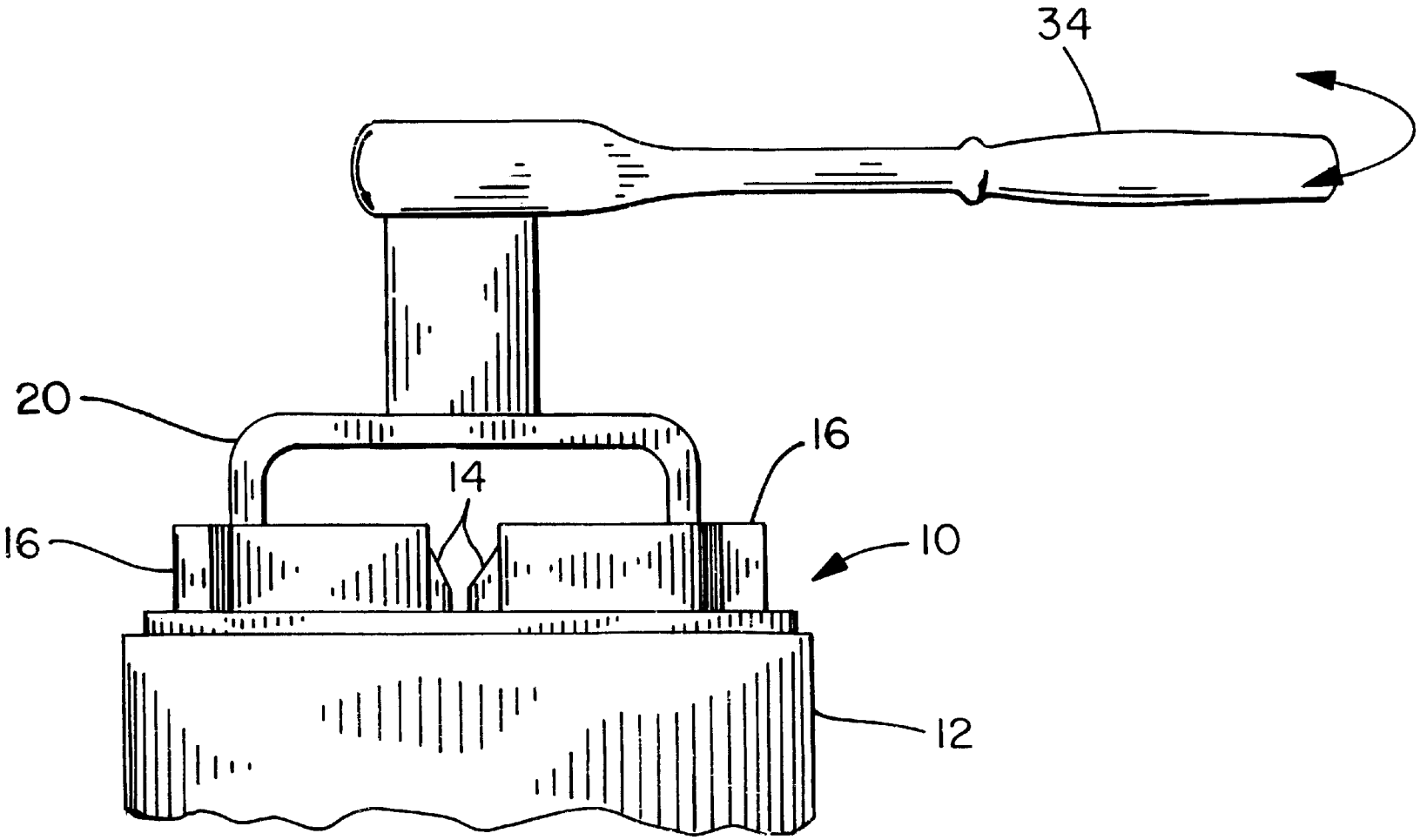
FIG. 12 is a side elevation view showing a ratchet wrench drive being engaged with the tool of the present invention to turn the tool and fuel filter cap in a desired direction.

As best shown in FIGS. 10–12, the tool 20 is used by disposing the tool 20 over the cap 10 such that the notches 28 on the ends of the legs 24 straddle one of the ribs 14 on the cap 10 to engage the cooperating rib 14. A drive means such as a ratchet wrench 34 is disposed in the opening in the boss or in the base, or a wrench or socket may engage the boss depending upon the embodiment of the tool 20. The tool 20 can then be turned in a forward or reverse direction to rotate the tool 20 and the cap 10 concurrently, to remove or install the cap 10. The tool 20 may be "U" shaped, "V" shaped or have an in between configuration.

The tool 20 may be constructed of metal or of a high density, reinforced plastic.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A tool for use in combination with a fuel filter cap, the fuel filter cap having a plurality of sets of spaced-apart ribs formed radially within an upper surface thereof, the tool comprising:

a U-shaped body having a base having opposite ends, a pair of legs, each leg formed at a right angle at one of said opposite ends of the base, each leg having an end distal from the base, a notch being formed in the respective end of each leg, the notches being planarly aligned with one another, a means for engaging a drive being formed at approximately a midpoint of the base, wherein the tool is disposed over the fuel filter cap with the respective notches in the legs engaging the cooperating sets of ribs on the fuel filter cap, and wherein the tool with the cap may be rotated in a forward or a reverse direction.

2. The tool of claim 1, wherein the means for engaging the drive is an opening formed in the base.

3. The tool of claim 1, wherein the means for engaging the drive is a boss formed on the approximate midpoint of the base, the boss having an opening therein to receive the drive.

4. The tool of claim 1, wherein the means for engaging the drive is a boss formed on the approximate midpoint of the base, the boss having a hexagonal outer perimeter to be received in a cooperating drive.

* * * * *